United States Patent [19]

Bloch et al.

[11] 4,091,450

[45] May 23, 1978

[54] METHOD AND APPARATUS FOR SET POINT CONTROL FOR STEAM TEMPERATURES FOR START-UP OF THE TURBINE AND STEAM GENERATOR IN UNIT POWER PLANTS

[75] Inventors: Heinz Bloch, Nussbaumen; Max Salm, Wettingen, both of Switzerland

[73] Assignee: BBC Brown Boveri & Company Limited, Baden, Switzerland

[21] Appl. No.: 742,761

[22] Filed: Nov. 18, 1976

[30] Foreign Application Priority Data

Jan. 28, 1976 Switzerland ..... 1061/76

[51] Int. Cl.[2] ..... G06G 7/63; F01K 13/02; F01D 19/00

[52] U.S. Cl. ..... 364/494; 60/646; 60/660; 415/17

[58] Field of Search ..... 235/151.21, 151; 60/227, 233, 39.05, 39.13, 39.14, 39.18 A, 39.18 B, 39.24, 39.26, 39.28, 39.3, 39.53, 39.54, 660, 646, 664, 676; 415/15, 17, 19, 20; 290/40 R, DIG. 1

[56] References Cited

U.S. PATENT DOCUMENTS

| | | | |
|---|---|---|---|
| 3,446,224 | 5/1969 | Zwicky, Jr. | 415/17 |
| 3,561,216 | 2/1971 | Moore, Jr. | 415/17 X |
| 3,588,265 | 6/1971 | Berry | 415/17 X |
| 3,928,972 | 12/1975 | Osborne | 60/646 |
| 4,005,581 | 2/1977 | Aanstad | 60/660 |

*Primary Examiner*—Joseph F. Ruggiero
*Attorney, Agent, or Firm*—Frank L. Durr; Orville N. Greene

[57] ABSTRACT

Method and apparatus for controlling the set point for steam temperatures for cold start-up of a steam generator-turbine unit wherein inlet steam temperature and turbine load absorption are steadily and substantially simultaneously increased in accordance with a predetermined relationship so as to reach their final values substantially synchronously.

5 Claims, 1 Drawing Figure

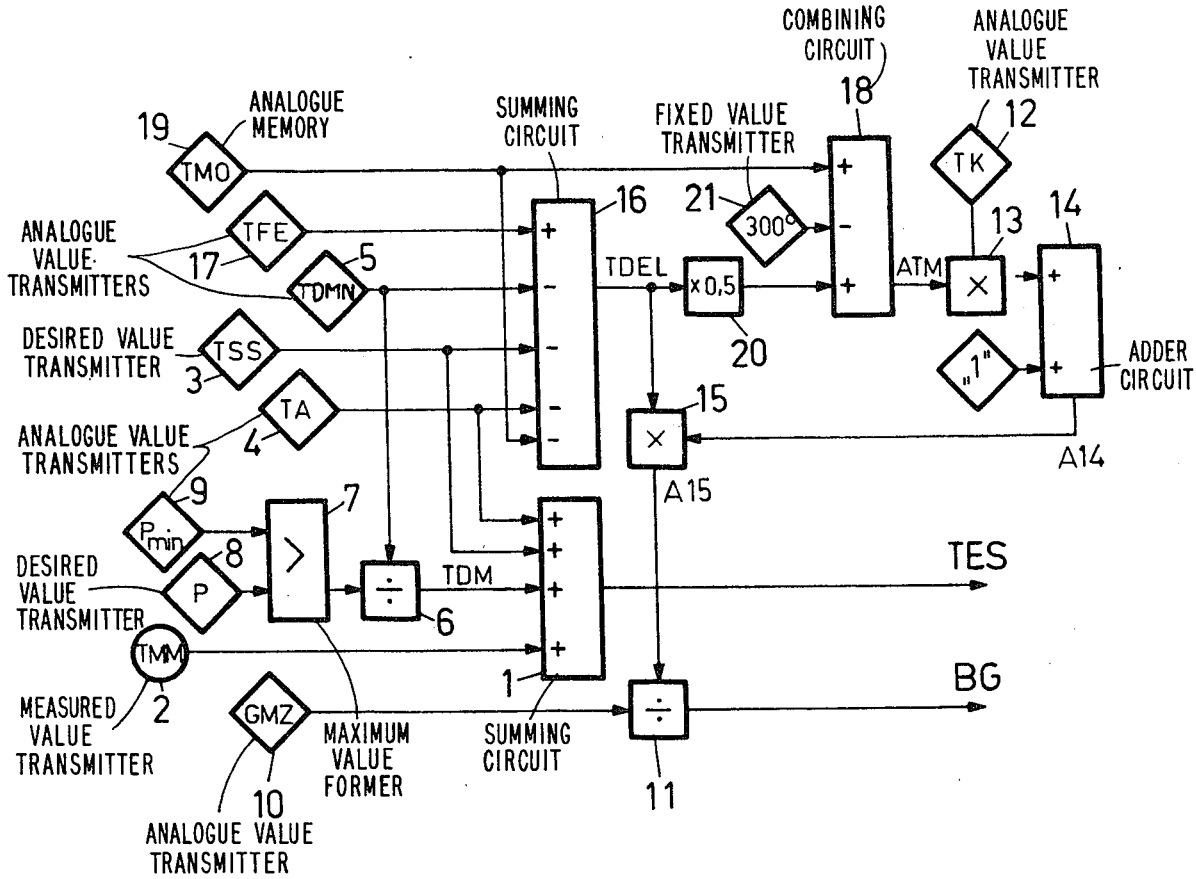

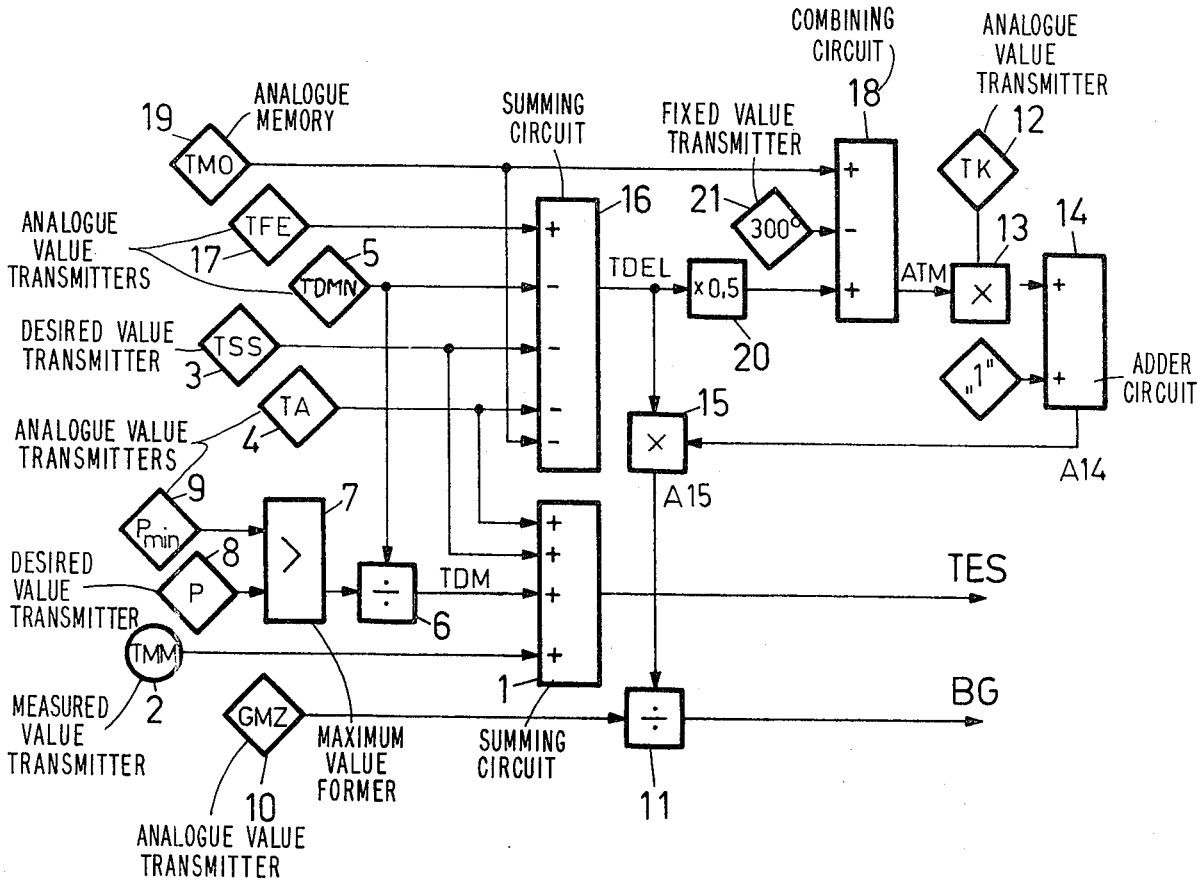
ANALOGUE MEMORY
19
TMO
ANALOGUE VALUE TRANSMITTERS
TFE
17
TDMN
5
DESIRED VALUE TRANSMITTER
TSS
3
TA
4
ANALOGUE VALUE TRANSMITTERS
9
Pmin
8
P
DESIRED VALUE TRANSMITTER
TMM
2
MEASURED VALUE TRANSMITTER
GMZ
10
ANALOGUE VALUE TRANSMITTER
7
MAXIMUM VALUE FORMER
6
TDM
SUMMING CIRCUIT
16
TDEL
1
SUMMING CIRCUIT
FIXED VALUE TRANSMITTER
21
300°
x 0,5
20
15
A15
11
COMBINING CIRCUIT
18
ATM
ANALOGUE VALUE TRANSMITTER
12
TK
13
14
"1"
ADDER CIRCUIT
A14
TES
BG

METHOD AND APPARATUS FOR SET POINT CONTROL FOR STEAM TEMPERATURES FOR START-UP OF THE TURBINE AND STEAM GENERATOR IN UNIT POWER PLANTS

BACKGROUND OF THE INVENTION

The invention relates to a method of set point control for steam temperatures for the start-up of a turbine and a steam generator in unit power plants.

When starting up steam turbines, in particular at initially low metal temperatures (cold start), provision must be made for suitable control of the steam throughput or steam temperature so that the stationary thermal stress in the thick-walled metal parts of the turbine do not exceed safe limits. On the other hand, the permissible values are to be utilized fully, so that the start-up time will be short and the energy losses kept low as are practical. Arrangements have become known which make it possible to fulfill these requirements (see for example Brown Boveri Mitteilungen 51 (1964), No. 3, p. 156–164).

The practice has shown that while the start-up process can be optimally regulated by such arrangements with respect to the turbine alone (see Brown Boveri Mitteilungen 51 (1964), No. 3, p. 186–194), this is not so for the entire system combination. If the steam temperatures are much above the metal temperatures, the load absorption of the turbo group is greatly decelerated by the probe control for a protracted time, in order then to reach the final value at increasing speed (see, e.g. Brown Boveri Mitteilungen 45 (1958), No. 7/8, p. 341, FIG. 6c). Not only is this load pattern undesirable from the viewpoint of the load distributor, but it also frequently leads to difficulties in the boiler control.

When starting up at steam temperatures which differ by a small amount from the metal temperatures but are low, the probe control alone would bring the turbo group to a high steam throughput quickly, but because of low enthalpy of the steam this does not lead to a corresponding load absorption and is not readily permissible because of too wet a steam in the end stages.

It is an object of the invention to avoid the disadvantages of the known solutions in particular in unit power plants. This is achieved by means which, for the purpose of optimal system start-up, coordinate the start-up of the turbo group and steam generator in such a way that during the start-up, at full utilization of the permissible stresses of the turbine, the load absorption of the turbo group and the inlet steam temperature are increased simultaneously and steadily, and more particularly so that both quantities reach their end values synchronously and in a time as short as is practically possible in view of any disturbing factors.

The invention will now be explained in greater detail with the aid of the one and only FIGURE given as an example.

As is evident from "Brown Boveri Mitteilungen" 45 (1958), No. 7/8, p. 339, upon the start-up of steam turbines, i.e., upon the warming up of thick-walled metal parts, uniform stresses will result during the entire time of this process based on the condition that the surface temperature TMO rises first at a discontinuity or "jump" and thereafter increases at an appropriate slope. The mean metal temperature TMM is thus represented by a slope type curve from the start.

According to the proposed method, a start-up probe is provided which measures the value TS = TMO - TMM, which value is representative of the stress of the turbine. The value TS is maintained at the desired value TSS by the acceleration regulator (load regulator) by control of the steam throughput Thus the heat flow QS flowing into the probe is also constant.

On this basis it is possible to calculate in a simple manner the desired value TES of the entrance steam temperature needed for the steam temperature set point control, with the aid of appropriate computing and measuring units.

If TA is the temperature drop between turbine inlet and probe measuring point, and TDM the temperature drop steam-to-metal, it follows that $$TES = TMM + TSS + TDM + TA,$$

TMM being measured, and TSS and TA being quantities given by the machine data. TDM depends on the heat transfer steam-to-metal and on the heat flow QS flowing through the interface, which, as set forth above, is constant. According to "Brown Boveri Metteilungen" 45 (1958), No. 7/8, page 341. FIG. 5, p. 341, the heat transfer $\alpha/\alpha o$ is a function of the load. In a practical application a linear relationship can be assumed. If TDMN is the temperature drop steam-to-metal at the nominal load $P_n$, there follows for the load P:

$$TDM \approx TDMN \times P_n/P.$$

To avoid the sometimes very undesirable effect that initially a high steam temperature is demanded, then one passing through a minimum and only then again a rising steam temperature, P must be limited to the minimum value $P_{MIN}$ before insertion in the temperature set point calculation. Hence:

$$TES = TMM + TA + TDMN \times P_n/MAX(P, P_{MIN}) \quad (1)$$

According to the above, this is the desired value of the inlet steam temperature and suitable calculating units still to be described for realizing the above relation provide that, according to the proposed method with a uniform rise of the load absorption P, TES is also increased uniformly, so that both quantities reach their end values simultaneously.

In the proposed method there is to be calculated, in addition to the desired temperatures of the steam for the information of the load distributor, a prognosis at the start moment for the mean load variation in time.

This calculation occurs on the basis that the described set point control brings the steam temperature to its target value in the same period of time as the start-up regulation of the load. The probe value adjusted to the desired value TSS is proportional to the permissible mean metal temperature variation in time, GMZ; we have GMZ = TSS/ZKS where ZKS is a characteristic time constant determined by the dimensions and material constants of the probe. If the metal temperature TM must pass through the temperature difference TDEL during start-up, then the time interval necessary for this is $t$ + TDEL/GMZ and hence the mean load variation in time in %/sec $$BG = 100 \times GMZ/TDEL$$

Because of the temperature dependence of the determining material constants, the time constant ZKS and hence the time interval $\Delta t$ for start-up are also dependent on the metal temperature. In the proposed method this fact is taken into consideration by calculating the mean of the mean metal temperature or more particularly its deviation ATM from a reference temperature, preferably 300° C, introducing an appropriate correction of the permissible mean metal temperature variation in time referred to the reference temperature with the combined temperature coefficient TK of the material constants; this gives the prognosis BG for the mean load variation in time $$BG = 100 \times GMZ/[TDEL \times (1 + ATM \times TK)] \quad (2)$$

If a mean variation in time is calculated for the high-pressure and the medium-pressure cylinders, the smaller value is controlling.

As has been remarked above, this prognosis BG calculated at the starting moment for the mean variation of the load in time is developed first for the information of the load distributor. In the sense of the proposed method, the quantity BG can also be alternatively introduced advantageously into the acceleration (load) regulator. Taking into account the turbine stress, the load set point is influenced further by the quantities determined by the start-up probes.

If the load process is not disturbed (e.g. by unforeseen fluctuations of the steam temperatures), the load set point and hence the load increases with a precalculated slope (BG). In this case there is no superposition of the probes because during the entire load process the actual probe values are almost coincident with their desired values.

BRIEF DESCRIPTION OF THE DRAWING

The FIGURE shows the diagram of set point control device for steam temperatures for use in practicing the described method.

DETAILED DESCRIPTION OF THE INVENTION

1 is a summing circuit in which according to equation (1) the following quantities are added:

a. the mean metal temperature TMM picked up by the measured value transmitter 2, b. the desired value TSS of the probe temperature difference, set at the desired value transmitter 3, c. the temperature drop TA between turbine inlet and probe measuring point, set at the analog value transmitter 4, d. the temperature difference TDM at the steam-to-metal surface at the momentary load P, which is formed in the following manner: The temperature difference TDMN steam-to-metal at full load, set at the analog value transmitter 5, is divided in the dividing circuit 6 by the relative load $P/P_n$ of the turbine. To prevent the possibility that at low load, a high temperature is initially demanded which high temperature would have to be reduced with increasing load (see above), there is first formed in the maximum value of the desired value P given out by the desired value transmitter 8 of the load regulator and of the value boiler minimum load $P_{MIN}$ set at the analog value transmitter 9.

The diagram illustrated in the sole FIGURE shows at the same time the elements serving to calculate the mean load variation in time BG = $dP/dt$. According to equation (2), the mean metal temperature variation in time GMZ = $dTM/dt$, set at the analog value transmitter 10 and permissible at 300° C, is divided in the dividing circuit 11 by the metal temperature difference TDEL to be traversed during start-up, rated at the temperature dependence of the material constants of the probe or respectively of the component reproduced thereby. The temperature dependence is taken into account by the expression (1 = ATM × TK).

The combined mean temperature coefficient TK of the heat propagation, set at the analog value transmitter 12, is multiplied in the multiplier circuit 13 by the deviation ATM of the mean value of the mean metal temperature from the reference temperature (300° ) observed during the entire starting-up process. In the adder circuit 14 is added further the quantity "1". The output signal A 14 is thus (1 = ATM × TK). This quantity is multiplied in the multiplier circuit 15 by TDEL. As described above, the output signal A 15 is applied to an input of the divider circuit 11, to yield the mean load variation BG.

As has been noted, TDEL is the metal temperature interval traversed during start-up. This quantity is formed in the combining circuit 16 from the steam end temperature TFE set at the analog value transmitter 17 less the temperature difference TDMN to steam-to-metal (full load); the temperature drop TA between turbine inlet and probe measuring point; and the probe set point TSS.

The deviation ATM of the mean of the mean metal temperature from 300° C is formed in the combining circuit 18 from the difference between the fixed value transmitter 21 (300° C) and the sum of the metal temperature TMO at the beginning of start-up, stored in the analog memory 19, plus the temperature difference TDEL halved in the multiplier circuit, i.e., 20

$$ATM = (TMO + TDEL/2) - 300.$$

What is claimed is:

1. A method for simultaneously starting up a steam turbine and a steam generator comprising the steps of:

(a) steadily increasing the load absorption of said steam turbine from a first to a second value;

(b) simultaneously and steadily increasing the temperature of said steam as it enters said turbine from a first to a second value;

(c) coordinating the rate of change of said load absorption and said steam temperature such that both quantities reach their respective second value simultaneously and in a time which produces only acceptable stresses in said turbine.

2. The method of claim 1 wherein the desired instantaneous temperature of said steam as it enters said turbine is controlled by a signal TES and wherein said signal is derived by the steps of:

computing a value TS = TMO − TMM, which is representative of the turbine stress, where TMO is the turbine surface temperature and TMM is the mean metal temperature of said turbine;

controlling the steam throughput using an acceleration regulator so as to maintain said value TS at a desired value TSS given by machine data; and computing the value of said signal TES in accordance with the following equation:

$$TES = TMM + TSS + +TA + TDMN \times P_n/\mathrm{MAX}(P, P_{MIN})$$

wherein;

TA is the temperature drop given by machine data from the entrance of said turbine to the point at which a probe measuring said value TMM is located;

P is the load;

$P_{MIN}$ is the minimum load;

$P_n$ is the nominal load;

TDMN is the measured temperature drop steam to metal at said nominal load $P_n$; and MAX ($P,P_{MIN}$) is the maximum of the two quantities P and $P_{MIN}$.

3. The method of claim 2 further including the step of computing a predicted mean load variation according to the relationship:

$$BG = 100 \times GMZ/(TDEL\ (1 + ATM \times TK)),$$

where:

BG = $dp/dt$ = the mean load variation in time,

GMZ = the mean metal temperature variation with respect to time, calculated as GMZ = TSS/ZKS wherein ZKS is a characteristic time constant determined by the dimensions and material constants of said probe, TDEL = the measured temperature difference traversed by the metal temperature TM during the start-up procedure, ATM = the calculated deviation of the mean value of the mean metal temperature, TK = the combined temperature coefficient of the material constants.

4. The method of claim 2 wherein said predicted mean load variation is utilized to control the load absorption of said turbine.

5. Apparatus for controlling the set point steam temperatures for start-up of a steam generator-turbine combination wherein start-up is optimized, characterized by the following apparatus units:

a. measured value transmitter (2) for generating a signal representative of the turbine mean metal temperature (TMM);

b. means (19) for generating a signal TMO representative of the surface metal temperature c. a first desired value transmitter (3) for generating a signal representative of the desired value (TSS) of a signal TS = TMO − TMM generated by a start-up probe, wherein TMO is the turbine surface temperature and TMM is the mean metal temperature of said turbine;

d. a first analog value transmitter (4) for generating a signal representative of the temperature drop (TA) between turbine inlet and said start-up probe;

e. a second analog value transmitter (5) for generating a signal representative of the temperature difference (TDMN) steam-to-metal at full load;

f. a second desired value transmitter (8) for generating a signal representative of the load set point (P);

g. a third analog value transmitter (9) for generating a signal representative of the value ($P_{MIN}$) of the minimum boiler load;

h. a maximum value transformer (7) for generating a signal MAX ($P,P_{MIN}$) representing the maximum of the two signals $P,P_{MIN}$;

i. a first divider circuit circuit (6) for generating a signal representative of the value TDMN/MAX ($P,P_{MIN}$);

j. a totalling circuit (1) for generating a signal TES representative of the desired value of the steam inlet temperature in accordance with the following equation:

$$TES = TMN + TSS + TA + TDMN \times P_n/\mathrm{MAX}\ (P,P_{MIN});$$

k. a fifth analog value transmitter (17) for generating a signal representative of the steam end temperature (TFE);

l. an analog memory (19) for storing the surface metal temperature (TMO) at the beginning of start-up;

m. a second totalling circuit (16) for generating a signal TDEL representative of the quantity [TFE -TDMN - TSS - TA - TMO];

n. a first multiplying circuit (20) for multiplying said signal TDEL by the constant factor 0.5;

o. a fixed value transmitter (21) for generating a signal T representative of a predetermined reference temperature;

p. a third totalling circuit (18) for generating a signal ATM representative of the quantity [RMO + 0.5 TDEL - T];

q. a fourth analog value transmitter (12) for generating a signal representative of the combined mean temperature coefficient (TK);

r. a second multiplying circuit (13) for multiplying said signal representative of said combined mean temperature coefficient (TK) signal by said signal ATM;

s. an adding circuit (14) for adding the output signal of said first multiplying circuit (13) and the quantity "1"; and for generating an output signal representative of said added quantity;

t. a third multiplying circuit (15) for multiplying said signal TDEL by said signal generated by said adding circuit (14);

u. a sixth analog value transmitter (10) for generating a signal representative of the mean metal temperature variation in time (GMZ = $dTM/dt$) permissible at said predetermined reference temperature; and v. a second dividing circuit (11) for generating a signal BG representative of the value GMZ/TDEL [1 = ATM × (TK)].

* * * * *